US007471909B2

(12) United States Patent
Haraguchi et al.

(10) Patent No.: US 7,471,909 B2
(45) Date of Patent: Dec. 30, 2008

(54) IMAGE FORMING APPARATUS

(75) Inventors: Manami Haraguchi, Yokohama (JP); Kenta Kubo, Shizuoka-ken (JP); Takeshi Yamamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 325 days.

(21) Appl. No.: 11/532,670

(22) Filed: Sep. 18, 2006

(65) Prior Publication Data

US 2007/0071473 A1 Mar. 29, 2007

(30) Foreign Application Priority Data

Sep. 21, 2005 (JP) ..... 2005-274079
Sep. 14, 2006 (JP) ..... 2006-249255

(51) Int. Cl.
*G03G 15/08* (2006.01)

(52) U.S. Cl. ..... 399/55; 399/285

(58) Field of Classification Search ..... 399/285, 399/270, 279, 265, 55
See application file for complete search history.

(56) References Cited

U.S. PATENT DOCUMENTS 5,669,036 A * 9/1997 Hotta et al.
5,678,130 A * 10/1997 Enomoto et al. ..... 399/55
5,701,551 A 12/1997 Honda et al.
5,835,819 A 11/1998 Yamamoto
6,337,966 B1 1/2002 Yamamoto
6,463,246 B1 * 10/2002 Mizuno et al. ..... 399/285
6,564,027 B2 5/2003 Haraguchi et al.
6,694,110 B2 2/2004 Akashi et al.
6,696,213 B2 * 2/2004 Yamaguchi et al. ..... 399/270
2002/0132176 A1 * 9/2002 Miyamoto
2005/0089340 A1 4/2005 Yamamoto
2007/0009272 A1 * 1/2007 Sheen ..... 399/55
2007/0071472 A1 3/2007 Kubo et al.

FOREIGN PATENT DOCUMENTS

JP 11-338170 12/1999
JP 2004-279902 10/2004
JP 2005165004 A * 6/2005

* cited by examiner

*Primary Examiner*—Susan S Lee
(74) *Attorney, Agent, or Firm*—Fitzpatrick, Cella, Harper & Scinto

(57) ABSTRACT

An image forming apparatus including: an image bearing member having a photoconductive layer of a capacitance per unit area of $1.7\times10^{-6}$ (F/m$^2$) or more; and a developing device having a developer carrying member to which development voltage is applied for developing a latent image to form a toner image on the image bearing member, wherein the following expression is satisfied:

$$\left|\frac{Q}{M}\right| \geq \frac{0.95\times Vcont}{\left(\frac{M}{S}\right)\times\left(\frac{L_t}{2\varepsilon_0\varepsilon_t}+\frac{Ld}{\varepsilon_0\varepsilon_d}\right)}$$

where Q/M (C/g): an electric charge quantity per unit weight of the toner image, Vcont: a potential difference between a surface potential of the image bearing member and a direct current component of the development voltage, M/S (g/m$^2$): a toner weight per unit area of the maximum density portion, $L_t$ (m): a toner layer thickness in the maximum density portion, $L_d$ (m): a photoconductive layer thickness, $\epsilon_t$: a relative permittivity of the toner layer, $\epsilon_d$: a relative permittivity of the photoconductive layer, and $\epsilon_0$ (F/m): a vacuum permittivity.

7 Claims, 9 Drawing Sheets

IMAGE FORMING APPARATUS

BACKGROUND OF THE INVENTION

1. Field of the Invention

The present invention relates to an image forming apparatus, such as a copying machine and a printer, for visualizing an electrostatic latent image formed on an image bearing member with toner to obtain an image.

In particular, the present invention relates to an image forming apparatus in which a high-capacitance photoconductive layer whose capacitance per unit area is equal to or larger than $1.7\times10^{-6}$ (F/m$^2$) is used for the image bearing member.

2. Description of the Related Art

In general, in an electrophotographic image forming apparatus, an organic photoreceptor is widely used as a photosensitive member which is an image bearing member. FIG. 5 is a layer structural model view showing an example of the organic photoreceptor. In the organic photoreceptor, a charge generation layer 12 made of an organic material, a charge transport layer 13, and a surface protecting layer 14 are stacked on a metal base 11 in this order. A photoconductive layer of the organic photoreceptor includes the charge generation layer 12, the charge transport layer 13, and the surface protecting layer 14 except the metal base 11. Also, even if an undercoat layer is applied on the metal base 11, the photoconductive layer means the charge generation layer 12, the charge transport layer 13, and the surface protecting layer 14, that is, except for the metal base 11 and the undercoat layer (not shown). Incidentally, for the photosensitive member having no surface protecting layer 14, the photoconductive layer means the charge generation layer 12 and the charge transport layer 13.

A copying machine or a printer which is the electrophotographic image forming apparatus is greatly expected to move into a quick printing market with the advance of digitization, full colorization, and increase in speed on the copying machine or the printer.

However, in order to move into the quick printing market, it is essential to use an electrophotographic image forming apparatus capable of forming an electrostatic latent image with high resolution. In the case of the organic photoreceptor having a charge generation mechanism in an inner portion of the organic photoreceptor, charge diffusion occurs before charges reach a surface of the organic photoreceptor, so that there is a limit to an increase in resolution.

In recent years, a method using an amorphous silicon photosensitive member having a mechanism in which charges are generated in the vicinity of a surface of the amorphous silicon photosensitive member has drawn attention as a method of minimizing the charge diffusion to realize the increase in resolution (see, for example, Japanese Patent Application Laid-open No. 2004-279902).

In the amorphous silicon photosensitive member, as shown in a layer structural model view of FIG. 6, an amorphous silicon photoconductive layer is fundamentally formed on the metal base 11. The amorphous silicon photosensitive member is fundamentally united by superposing, on the metal base 11, the charge blocking layer 15, the charge generation layer 16, the charge blocking layer 17, and the surface layer 18 in order of mention as shown in the layer structural model view of FIG. 6. Here, the photoconductive layer of the amorphous silicon photosensitive member means the remaining obtained by eliminating the metal base 11 from the photosensitive member. That is, the photoconductive layer of the amorphous silicon photosensitive member means the charge blocking layer 15, the charge generation layer 16, the charge blocking layer 17, and the surface layer 18. The amorphous silicon photoconductive layer 15 is made of an amorphous silicon material such as a-Si, a-SiC, a-SiO, or a-SiON and formed by, for example, a glow discharge decomposition method, a sputtering method, an electron cyclotron resonance (ECR) method, or a vapor deposition method.

In order to obtain a high-resolution image, it is desirable that the photoconductive layer of the image bearing member have a high capacitance per unit area. To be specific, it is desirable to use a high-capacitance photoconductive layer whose capacitance per unit area is equal to or larger than $1.7\times10^{-6}$ (F/m$^2$). The amorphous silicon photosensitive member (hereinafter referred to as a-Si photosensitive member) has a permittivity approximately three times that of the organic photoreceptor. Therefore, when a thickness of the amorphous silicon photosensitive member is equal to a thickness of the organic photoreceptor (each of which is a total thickness obtained by subtracting a thickness of the metal base serving as a support member from a thickness of the photosensitive member), the capacitance per unit area of the photoconductive layer of the amorphous silicon photosensitive member becomes approximately three times that of the organic photoreceptor. In order to improve dot reproducibility, it is necessary that the thickness of the photoconductive layer be thinned to suppress the charge diffusion. In the case of the a-Si photosensitive member, it is found that it is necessary to set the thickness of the photoconductive layer to 50 μm or less to realize allowable dot reproducibility. In the case of the organic photoreceptor, it is found that it is necessary to set the thickness of the photoconductive layer to 17 μm or less to realize dot reproducibility equal to that of the a-Si photosensitive member. In this case, the capacitance per unit area of the photoconductive layer of the image bearing member is set to a lower limit. For the above-mentioned technical reasons, the above-mentioned capacitance ($\geqq 1.7\times10^{-6}$ (F/m$^2$)) is set.

Incidentally, the capacitance of the photoconductive layer is a value measured by the following method. A flat-shaped photosensitive plate is prepared by forming a layered structure same as the actual photoconductive layer on a metal base. An electrode smaller than the flat-shaped photosensitive plate is contacted to the flat-shaped photosensitive plate. A direct current voltage is applied to the electrode. At this time, the current passing the electrode is monitored. The monitored current is integrated in time to obtain a charge amount q accumulated in the photoconductive layer. These steps are performed while changing a value of the direct current. The capacitance of the photosensitive plate is obtained from an amount of change in the charge amount q. In this embodiment, the measurement is performed by using the flat-shaped photosensitive plate. If, however, the shape of an electrode is contrived so as to have the same curvature as the photosensitive member, the measurement can be performed by using a drum-shaped photosensitive member.

When the amorphous silicon photosensitive member (hereinafter referred to as a-Si photosensitive member) having the high capacitance is used, an extremely high-resolution image can be outputted. However, an image defect "blank area" generates unlike the case where the organic photoreceptor having the low capacitance is used.

As shown in FIG. 7, the "blank area" is an image defect in which, when an image pattern in which a medium contrast portion "A" and a high-density portion "B" are adjacent to each other in a traveling direction (i.e., rotating direction) of a surface of the a-Si photosensitive member is outputted, a density of an interface portion "C" there between significantly reduces. With respect to the traveling direction of the surface of the a-Si photosensitive member, there are both the case where the high-density portion "B" is located prior to the medium contrast portion "A" and the case where the medium contrast portion "A" is located prior to the high-density portion "B".

As a result of concentrated studies on the generation reason of the "blank area", it is found that the "blank area" is generated by the following mechanism. This will be described in detail below.

FIG. 8 shows an electrostatic latent image potential on a photosensitive member. This example shows a combination of a photosensitive member-negative charging processing, image exposure, and reversal development. An unexposed portion becomes a background portion (i.e., non-image portion). In FIG. 8, reference symbol Vl denotes a latent image potential of the high-density portion "B" on an image area, reference symbol Vh denotes a latent image potential of the medium contrast portion "A" on the image area, and reference symbol Vd denotes a latent image potential of a non-image portion D. When a development bias voltage is applied to a developing sleeve serving as a developer carrying member of a developing device in order to perform development with the latent potentials, toner is transferred from the developing sleeve to the image area of the photosensitive member to develop a latent image. This is because each of a development contrast voltage Vcont corresponding to a potential difference between a direct current voltage component Vdc of the development bias voltage and the latent image potential Vl of the high-density portion "B" on the image area, and a development contrast voltage Vcont-h corresponding to a potential difference between the direct current voltage component Vdc of the development bias voltage and the latent image potential Vh of the medium contrast portion "A" on the image area, is to be filled with (i.e., to be eliminated by) toner charges.

However, there is a difference between the development contrast voltages Vcont and Vcont-h in the interface portion between the medium contrast portion "A" and the high-density portion "B", so a wraparound electric field extending from the medium contrast portion to the high-density portion is formed near the surface of the photosensitive member in addition to an electric field extending from the developing sleeve to the photosensitive member. FIG. 10 shows electric field vectors located near the surface of the photosensitive member in the interface portion between the high-density portion and the medium contrast portion. In the beginning of a developing process, toner present near the interface portion and toner present in the medium contrast portion follow the electric field vectors shown in FIG. 10 by the wraparound electric field, so that most of the toners transfers to a latent image of the high-density portion.

When the development contrast voltage Vcont on the high-density portion is reduced by the toner charges with the progress of the developing process, a toner outermost layer potential of the high-density portion is close to Vdc. Therefore, the difference between the development contrast voltage Vcont on the high-density portion "B" and the development contrast voltage Vcont-h on the medium contrast portion "A" becomes smaller, so that the wraparound electric field disappears. As a result, the toner transferred from the developing sleeve to the medium contrast portion is prevented from transferring toward the high-density portion. Finally, the development contrast voltage on each of the medium contrast portion and the high-density portion is filled with (i.e., eliminated by) the toner charges to complete the developing process.

However, as shown in FIG. 9, when the toner charges become a state in which the development contrast voltage on the high-density portion relative to the latent image potential thereof cannot be filled (eliminated) before the image area passes through a development region, the image area passes through the development region without disappearance of the wraparound electric field. Therefore, a sufficient toner amount is not transferred to a latent image of the medium contrast portion, thereby generating the "blank area" in the interface portion "C" located between the medium contrast portion "A" and the high-density portion "B". In FIG. 9, black portions of each of the latent image potentials correspond to a toner outermost layer potential. That is, a toner outermost layer potential on the medium contrast portion "A" is expressed by Vdc and a toner outermost layer potential on the high-density portion "B" is expressed by Vs. Therefore, in the high-density portion "B", a potential difference (Vs−Vl) filled by developing the toner become extremely smaller than the development contrast voltage Vcont.

Note that a state in which the development contrast voltage cannot be filled with (eliminated by) the toner charges is expressed as "charging failure".

Next, the reason why the "blank area" is not generated in a conventional organic photoreceptor but generated in the a-Si photosensitive member will be described.

The a-Si photosensitive member has a material characteristic in which a relative permittivity is three times that of the organic photoreceptor ((relative permittivity of a-Si photosensitive member): approximately 10, (relative permittivity of organic photoreceptor): approximately 3.3). When the a-Si photosensitive member has a photoconductive layer thickness equal to that of the organic photoreceptor, the a-Si photosensitive member has a capacitance three times that of the organic photoreceptor.

As a result, a toner charge amount necessary to satisfy the development contrast voltages Vcont and Vcont-h for the a-Si photosensitive member is approximately three times that for the organic photoreceptor. For example, when development is to be performed with a charged toner amount equal to that for the conventional organic photoreceptor, it is necessary that a toner amount for the a-Si photosensitive member be approximately three times that for the organic photoreceptor.

A toner amount which is present in a developing nip is limited, so the toner amount necessary to sufficiently satisfy the development contrast voltage Vcont for the a-Si photosensitive member cannot be developed under the circumstances. In particular, in order to fill the development contrast voltage Vcont on the high-density portion whose potential difference is large, an extremely large charge amount is necessary. However, because the toner amount which is present in the developing nip and can be developed is limited, the development contrast voltage Vcont cannot be filled for the a-Si photosensitive member.

As a result, the "charging failure" occurs, so that the image defect called the "blank area" generates.

Of course, even in the case of the organic photoreceptor, a high-resolution image is obtained by thin film processing for reducing the thickness of the photoconductive layer. In the organic photoreceptor, charges optically induced from the charge generation layer are diffused, so it is necessary to reduce the thickness of the photoconductive layer to improve the resolution. In order to obtain the same resolution as that in the case of the a-Si photosensitive member, it is only necessary that the thickness of the photoconductive layer of the organic photoreceptor be equal to or smaller than 17 μm as described above. When the thickness of the photoconductive layer is converted into a capacitance thereof, a lower limit thereof becomes $1.7\times10^{-6}$ (F/m$^2$). Therefore, as in the case of the a-Si photosensitive member, a high-capacitance organic photoreceptor whose capacitance is made equal to or larger than $1.7\times10^{-6}$ (F/m$^2$) by thin film processing has a problem in which the "charging failure" occurs, so that the image defect called the "blank area" generates.

SUMMARY OF THE INVENTION

An object of the present invention is to provide an image forming apparatus capable of reducing generation of a blank area of an image.

Another object of the present invention is to provide an image forming apparatus capable of reducing generation of an image defect of an interface between a high-density portion and a medium contrast portion.

Another object of the present invention is to provide an image forming apparatus capable of reducing charging failure caused by toner charges in a latent image potential during development.

Another object of the present invention is to provide an image forming apparatus capable of performing high-resolution image formation.

Another object of the present invention is to provide an image forming apparatus using a high-capacitance photoconductive layer whose capacitance per unit area is equal to or larger than $1.7\times10^{-6}$ (F/m$^2$).

Further features of the present invention will become apparent from the following description of exemplary embodiments with reference to the attached drawings.

DESCRIPTION OF THE EMBODIMENTS

Hereinafter, an image forming apparatus according to the present invention will be described in more detail with reference to the attached drawings.

Embodiment 1

(1) Schematic Structural Description of Image Forming Apparatus Example

Figure 1:
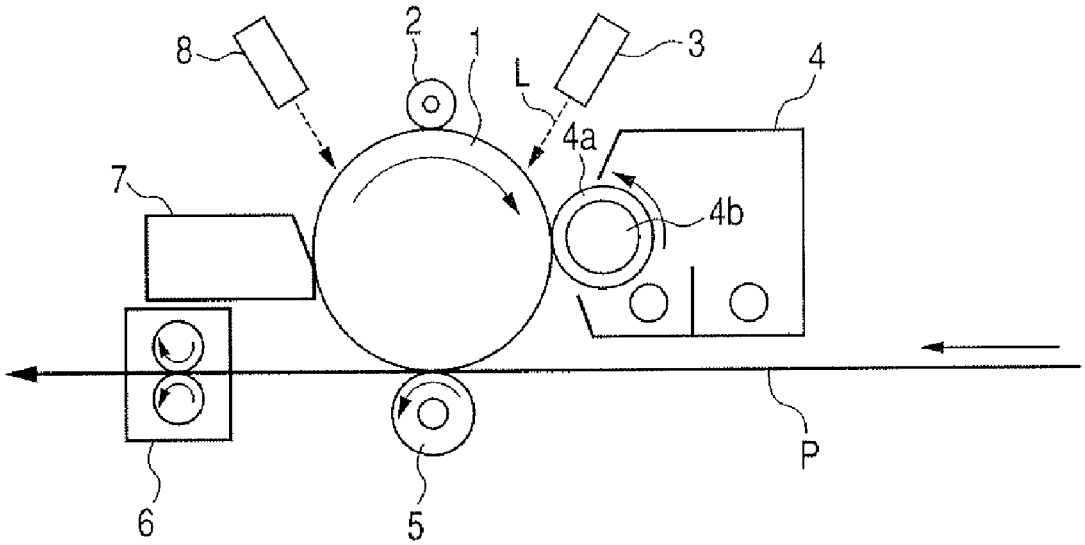
FIG. 1 is a schematic structural model view showing an image forming apparatus according to Embodiment 1 of the present invention.

FIG. 1 is a schematic structural model view showing an image forming apparatus according to this embodiment. The image forming apparatus according to this embodiment is an electrophotographic laser printer using an amorphous silicon photosensitive member (a-Si photosensitive member) as an image bearing member. The a-Si photosensitive member is a photosensitive member of negative charge polarity. An image exposure system and a reverse developing system are employed and a resolution is 1200 dpi.

Figure 6:
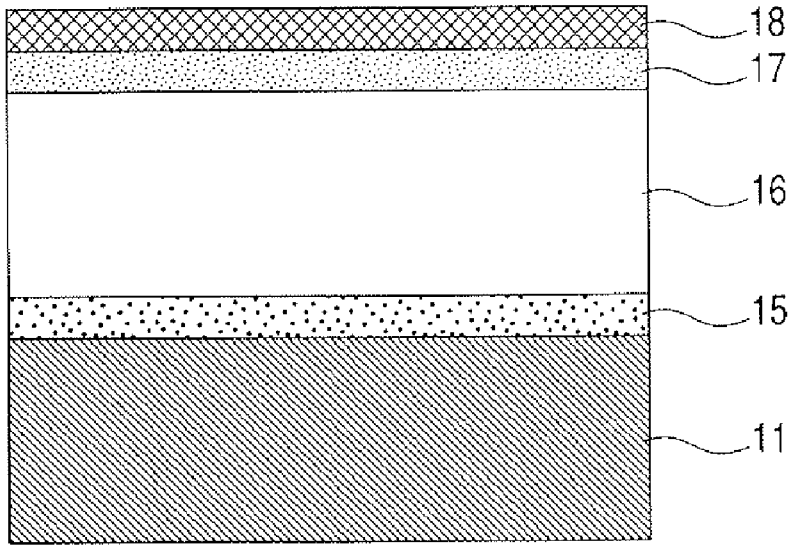
FIG. 6 is a layer structural model view showing an amorphous silicon photosensitive member.
Figure 7:
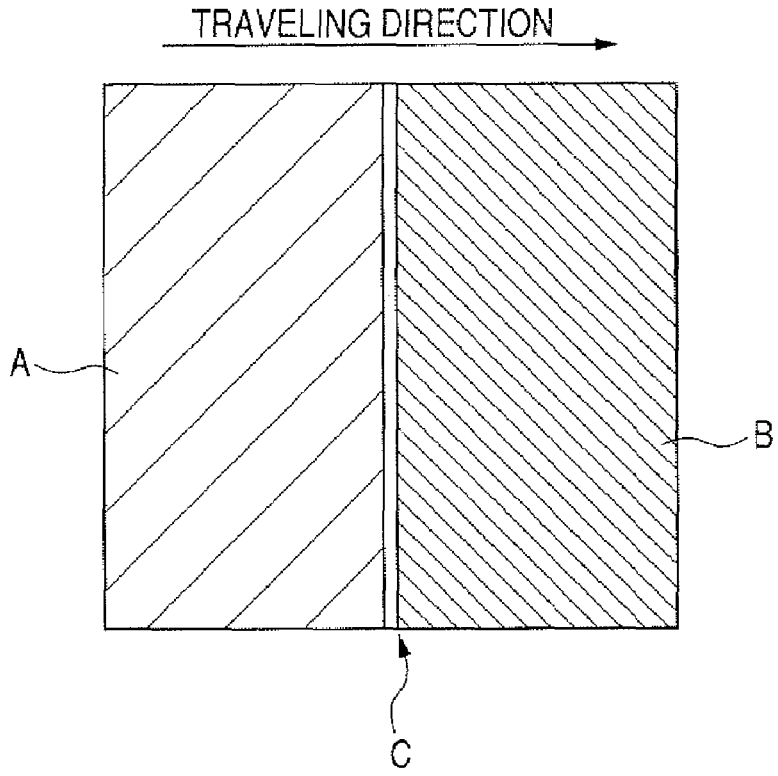
FIG. 7 is an explanatory view showing a blank area phenomenon.
Figure 8:
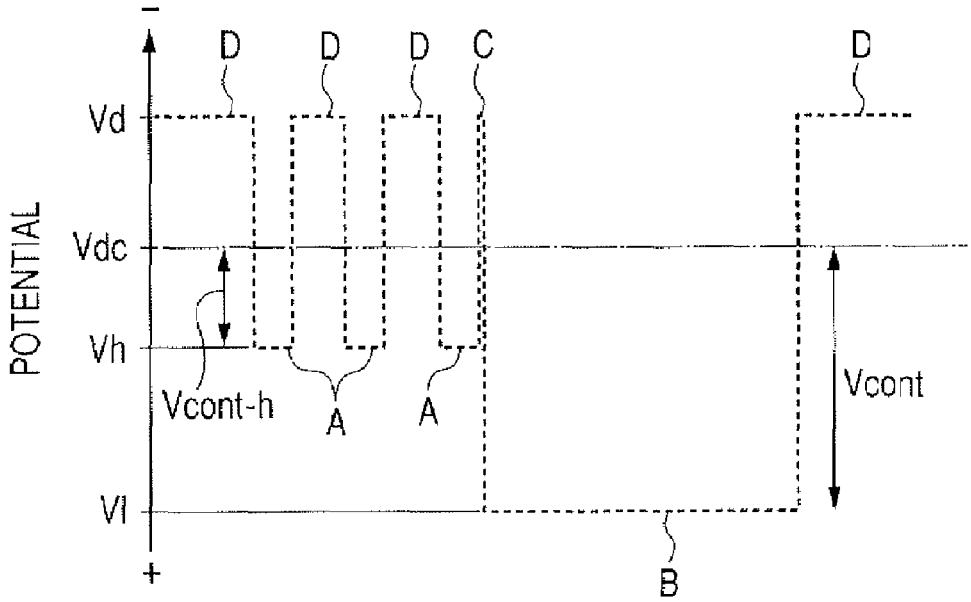
FIG. 8 is a diagram showing a latent image potential on an image bearing member.

A drum-shaped a-Si photosensitive member 1 includes a photoconductive layer formed on an aluminum base 11. The photoconductive layer comprises an electron blocking layer 15, a charge generation layer 16, a hole blocking layer 17, and a surface layer as shown in FIG. 6. A thickness $L_d$ of the photoconductive layer is 40 μm (=$40\times10^{-6}$ m) and a capacitance per unit area of the photoconductive layer is $2.2\times10^{-6}$ (F/m$^2$).

The photosensitive member 1 is rotated at predetermined speed in a clockwise direction indicated by an arrow and a surface thereof is uniformly charged to −500 V by a charger 2.

Next, the charged surface is subjected to optical image exposure L by an exposure device 3 to form an electrostatic latent image on the surface of the photosensitive member. In this embodiment, the exposure device 3 is a laser scanner. The scanner emits a laser beam modulated according to an image signal inputted from a host apparatus (not shown) such as a personal computer to the image forming apparatus to perform scanning exposure L on the charged surface of the photosensitive member 1. As a result, a potential of an exposed light portion of the surface of the photosensitive member reduces, so the electrostatic latent image of an image pattern corresponding to the image signal is formed on the surface of the photosensitive member by a potential contrast between a potential of a dark portion which is not exposed and the potential of the exposed light portion. In this embodiment, a latent image potential Vl of a maximum density portion, which is the potential of the light portion, is −150 V. The maximum density portion is a portion in which a potential difference between a direct current component of a development bias voltage and an image area potential (light portion potential) of the electrostatic latent image is maximum, that is, a solid image portion.

Next, the electrostatic latent image is reversely developed as a toner image by a developing device 4. In this embodiment, the developing device 4 is a developing device of two-component development. A two-component developer composed of toner (7 μm in particle diameter) and a carrier (35 μm in particle diameter) is carried by a developing sleeve 4*a*, which is a rotatable developer carrying member. The developer is transported to the vicinity of a portion opposed to the photosensitive member 1 by the developing sleeve 4*a* and a magnet roller 4*b* fixedly located therein. A development bias voltage in which an alternating current component is superimposed on a direct current component Vdc of −350 V is applied to the developing sleeve 4*a*. Therefore, the toner is moved to an image area by a potential difference between the latent image potential on the photosensitive member 1 and the development bias voltage applied to the developing sleeve 4*a* to visualize the electrostatic latent image as the toner image.

Then, in a transferring portion in which the photosensitive member 1 and a transferring charger 5 are opposed to each other, the toner image is electrostatically transferred to a recording material P conveyed from a sheet feeding mechanism portion (not shown) to the transferring portion at a predetermined control timing.

The recording material P passing through the transferring portion is separated from the surface of the photosensitive member 1 and introduced into a fixing device 6. Then, the toner image which is not fixed is fixed by hot pressing and the recording material P including the fixed toner image is delivered as a print to an outside of the image forming apparatus.

The photosensitive member 1 separated from the recording material is subjected to the removal of a residual deposit such as a transfer residual toner by a cleaner 7 and electrically initialized by the entire surface exposure using a pre-exposure lamp 8. Therefore, the photosensitive member is repeatedly used for image formation.

(2) Prevention of Blank Area (2-1) Part 1

In the above-mentioned image forming apparatus, a state of generation of the "blank area" is examined. That is, in the case where a weight per unit area (M/S) of toner of the maximum density portion on the photosensitive member is 0.5 mg/cm$^2$ to 0.8 mg/cm$^2$ (=5 g/m$^2$ to 8 g/m$^2$), a quantity of electric charge per unit weight (Q/M) of toner on the photosensitive member is changed to examine the state of generation of the "blank area" at the time when an image in which a medium contrast portion and the maximum density portion are adjacent to each other is outputted.

The reason why M/S is set to 0.5 mg/cm$^2$ to 0.8 mg/cm$^2$ is that this is an amount capable of maintaining a sufficient image density even in the maximum density portion.

The control of Q/M and M/S is performed by adjusting a type of an extraneous additive added to toner and an extraneous additive amount, a type of a coating agent applied to a carrier surface and a coating agent amount, a toner/carrier ratio, and the amount of developer on the developing sleeve.

The values of Q/M and M/S are obtained by measurement on the toner present on the photosensitive member using the following measurement method.

Figure 15:
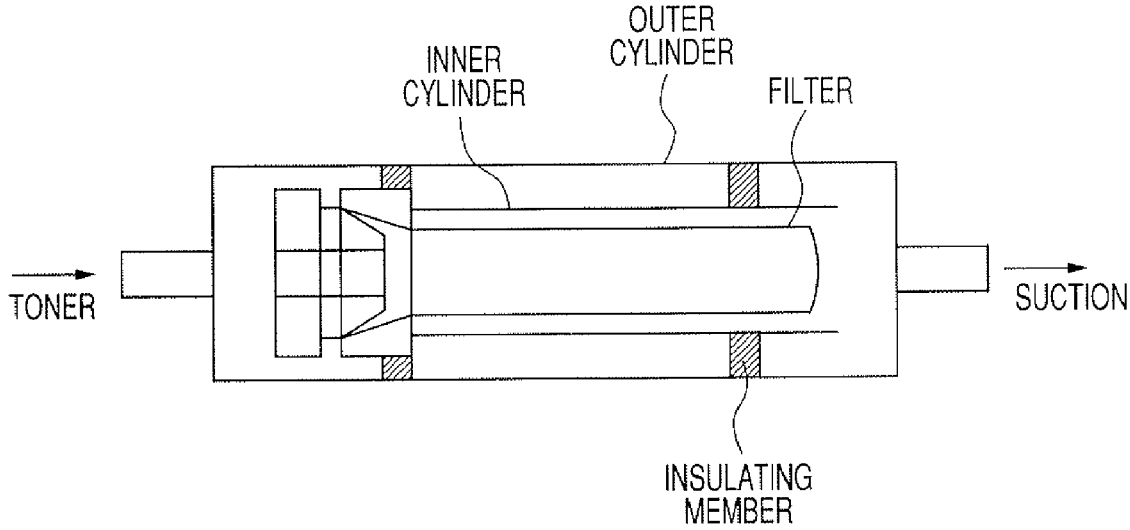
FIG. 15 is a schematic view showing a Faraday gauge used to obtain Q/M and M/S.

In order to perform measurement on the toner present on the photosensitive member, the image forming apparatus is tuned off at a timing when the toner is developed on the photosensitive member during an image formation operation. The toner present on the photosensitive member is air-sucked using a Faraday gauge including inner and outer cylinders and a filter as shown in FIG. 15. The inner and outer cylinders which are made of metal and have different axis diameters are located such that the axes thereof are aligned with each other. The filter is used to further introduce the toner into the inner cylinder. In the Faraday gauge, the inner cylinder and the outer cylinder are insulated from each other. When the toner is introduced into the filter, electrostatic induction is caused by the quantity of electric charge Q of the toner. The induced quantity of electric charge Q is measured by a Coulomb meter (Keithley 616, digital electrometer) and is divided by the weight M of toner in the inner cylinder to obtain Q/M (μC/g). The area S of the attracted toner on the photosensitive member is measured and the weight M of toner is divided by a measured value to obtain M/S (mg/cm$^2$).

With respect to the maximum density portion, a development contrast voltage Vcont corresponding to a potential difference between the direct current voltage component Vdc of the development bias voltage and the potential Vl of the light portion of the photosensitive member is 200 V. With respect to the medium contrast portion, a development contrast voltage Vcont-h corresponding to a potential difference between the direct current voltage component Vdc of the development bias voltage and the potential Vh of the medium contrast portion of the photosensitive member is 100 V.

As described above, the development contrast voltage is the potential difference between the potential Vl (or Vh) of the image area on the photosensitive member in a development position and the direct current voltage component Vdc of the development bias voltage applied to the developing sleeve.

The potential of the image area on the photosensitive member in the development position is obtained as follows. That is, a surface potential meter is placed in a position in which the developing device is located to measure a surface potential of the photosensitive member during image formation operation. The surface potential and the direct current voltage component Vdc of the development bias voltage are subtracted from each other to obtain the potential of the image area.

Figure 2:
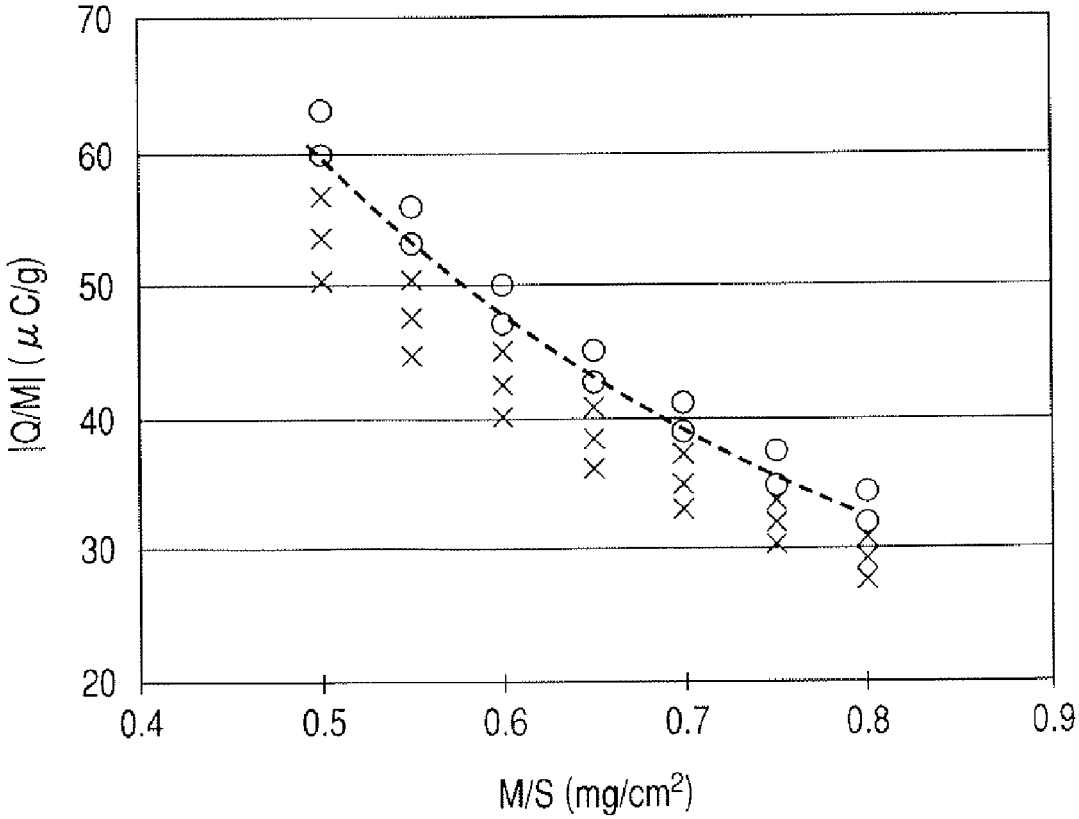
FIG. 2 is a graph showing a result obtained by study in Embodiment 1 (2-1) of the present invention.

FIG. 2 shows a result obtained by study. In FIG. 2, a mark "o" indicates that the "blank area" is not generated and a mark "x" indicates that the "blank area" is generated. For the image forming apparatus according to this embodiment, the reverse developing system is employed and the negatively-charged toner is used. Therefore, the ordinate in FIG. 2 indicates an absolute value of the quantity of electric charge per unit weight (Q/M) of the toner on the photosensitive member. As is apparent from FIG. 2, in each of:

the case of M/S=0.5 mg/cm$^2$ (=5 g/m$^2$) . . . |Q/M|≧60 μC/g (=60×10$^{-6}$ C/g);

the case of M/S=0.55 mg/cm$^2$ . . . |Q/M|≧53 μC/g;

the case of M/S=0.6 mg/cm$^2$ . . . |Q/M|≧47 μC/g;

the case of M/S=0.65 mg/cm$^2$ . . . |Q/M|≧43 μC/g;

the case of M/S=0.7 mg/cm$^2$ . . . |Q/M|≧39 μC/g;

the case of M/S=0.75 mg/cm$^2$ . . . |Q/M|≧35 μC/g; and the case of M/S=0.8 mg/cm$^2$ . . . |Q/M|≧32 μC/g;

the "blank area" is not generated.

A broken line shown in FIG. 2 indicates right-hand side values of Expression 1 which is an inequality expression in respective conditions. Table 1 shows values in the typical cases of M/S.

TABLE 1

| | 0.5 mg/cm$^2$ | 0.55 mg/cm$^2$ | 0.6 mg/cm$^2$ | 0.65 mg/cm$^2$ | 0.7 mg/cm$^2$ | 0.75 mg/cm$^2$ | 0.8 mg/cm$^2$ |
|---|---|---|---|---|---|---|---|
| (Expression 1) Right-hand side | 60.0 μC/g | 53.2 μC/g | 47.7 μC/g | 43.0 μC/g | 39.1 μC/g | 35.7 μC/g | 32.8 μC/g |

Here, Expression 1 is defined as follows.

$$\left|\frac{Q}{M}\right| \geq \frac{0.95 \times Vcont}{\left(\frac{M}{S}\right) \times \left(\frac{L_t}{2\varepsilon_0\varepsilon_t} + \frac{Ld}{\varepsilon_0\varepsilon_d}\right)} \quad \text{(Expression 1)}$$

The quantity of electric charge per unit weight of the toner image on the photosensitive member is expressed by Q/M (C/g). The potential difference between the surface potential of the photosensitive member and the direct current voltage component of the development bias voltage on the maximum density portion of the toner image on the photosensitive member is expressed by Vcont (V). The toner weight per unit area of the maximum density portion of the toner image on the photosensitive member is expressed by M/S (g/m$^2$). A thickness of a toner layer in the maximum density portion of the toner image on the photosensitive member is expressed by $L_t$ (m). The thickness of the photoconductive layer is expressed by $L_d$ (m). A relative permittivity of the toner layer is expressed by $\epsilon_t$. A relative permittivity of the photoconductive layer is expressed by $\epsilon_d$. A vacuum permittivity is expressed by $\epsilon_0$ (F/m).

Although the units shown in Table 1 are not equal to the units described in Expression 1, a dimension of the left-hand side of Expression 1 is equal to that of the right-hand side thereof. Therefore, it is necessary to convert the units shown in Table 1 into the units described in Expression 1. For example, when (M/S=0.5 mg/cm$^2$) shown in Table 1 is to be substituted into Expression 1, it is necessary to convert (M/S=0.5 mg/cm$^2$) into (M/S=5 g/m$^2$). At this time, it is necessary to convert (Q/M=60.0 μC/g) of the right-hand side of Expression 1 which is shown in Table 1 into ($60.0\times10^{-6}$ C/g). Of course, it is also necessary to convert the unit of Q/M into (C/g). As in the above description, when the units of Q/M and M/S shown in FIG. 2 are to be applied to Expression 1, it is necessary to convert the units thereof into (C/g) and (g/m$^2$).

Figure 9:
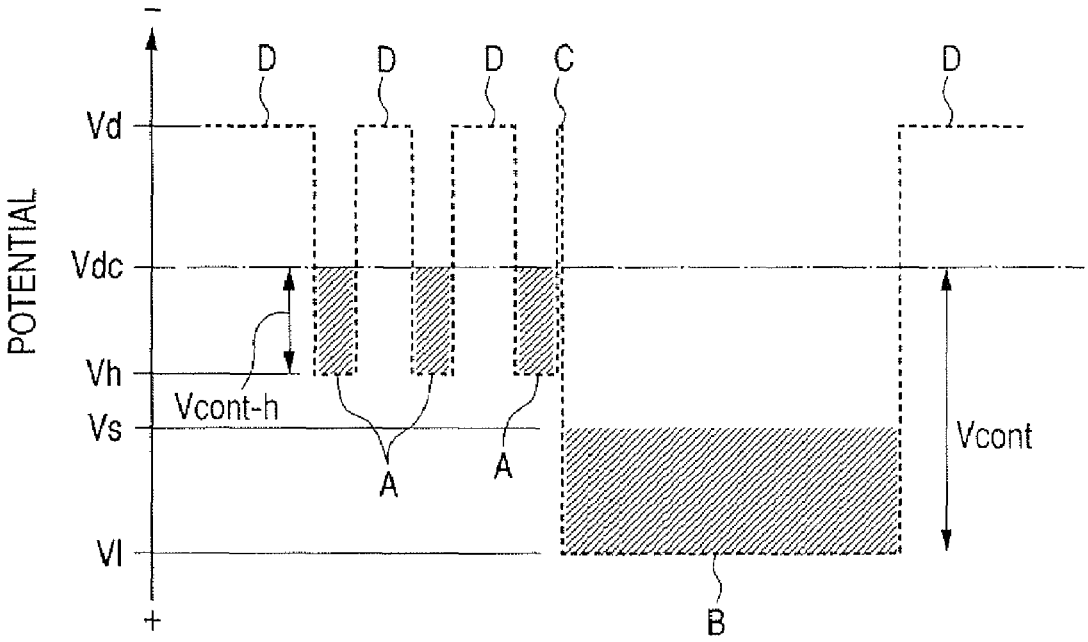
FIG. 9 is a diagram showing a latent image potential on the image bearing member after the completion of development.
Figure 10:
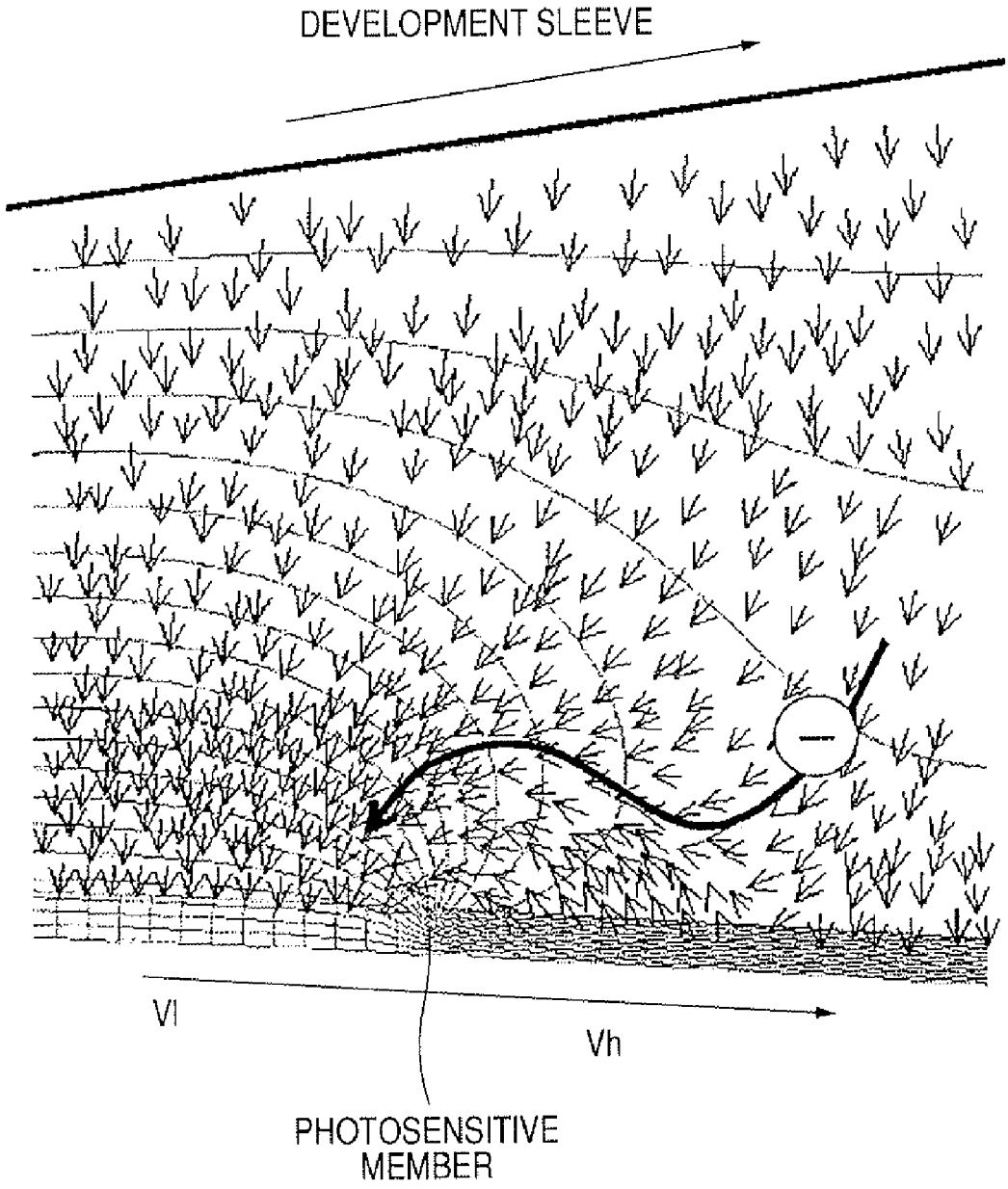
FIG. 10 is an explanatory view showing an a wraparound electric field.

As described above, an absolute value of the quantity of electric charge per unit weight Q/M of the toner developed on the image bearing member is set to a value equal to or larger than the right-hand side value of Expression 1. As a result, a potential caused by the toner developed on the image bearing member can be made equal to or larger than 95% of the development contrast voltage Vcont on the maximum density portion which requires a maximum quantity of electric charge. That is, in FIG. 9, a relationship of ($|Vl-Vs|/Vcont\times100\geqq95\%$) is obtained. The sign Vs denotes a surface potential of the toner layer on the image bearing member after the potential of the light portion is developed with toner, and is a value measured in the development position or in the vicinity of the development position. A method of deriving Expression 1 will be described later.

When the potential caused by the toner developed on the image bearing member is made equal to or larger than 95% of the development contrast voltage, a "wraparound electric field" generated by a potential difference near the interface portion between the medium contrast portion and the maximum density portion is reduced to a negligible value. Therefore, the movement of the toner present near the interface portion can be suppressed. As a result, the generation of the "blank area" in the interface portion between the medium contrast portion and the maximum density portion can be prevented.

When the toner weight per unit area (M/S) of the maximum density portion on the image bearing member is set to be equal to or larger than 0.5 mg/cm$^2$ and equal to or smaller than 0.8 mg/cm$^2$, a sufficient image density can be maintained in the maximum density portion.

When the maximum development contrast voltage Vcont for the maximum density portion is set to be equal to or larger than 150 V and equal to or smaller than 250 V, a γ-value necessary to obtain sufficient tone reproduction can be maintained. Therefore, it is possible to output a high-resolution image capable of clearly expressing a medium contrast.

In the case where an average particle diameter of toner is set to 7 μm or less, even when a laser spot diameter is set to a small diameter to realize an increase in solution, an isolated latent image can be clearly formed. Therefore, it is possible to output a high-resolution image having high dot reproducibility.

Method of Deviating Expression 1

A potential ΔV (hereinafter referred to as "charging potential") caused by the toner developed on the image bearing member is expressed by Expression 2 by the solution of Poisson's equation. The potential ΔV is |Vl−Vs| shown in FIG. 9, that is, a potential difference between the surface potential Vl of the image bearing member before development on the maximum density portion of the toner image formed on the image bearing member and the surface potential Vs of the toner image after development on the maximum density portion of the toner image formed on the image bearing member.

The first term of the right-hand side indicates a potential caused by a toner charge and the second term thereof indicates a potential caused between the toner charge and a base layer of the image bearing member.

$$\Delta V=\left(\frac{L_t}{2\varepsilon_0\varepsilon_t}\times\frac{Q}{M}\times\frac{M}{S}\right)+\left(\frac{L_d}{\varepsilon_0\varepsilon_t}\times\frac{Q}{M}\times\frac{M}{S}\right) \quad \text{(Expression 2)}$$

In order to reduce charging failure caused by the wraparound electric field generated near the interface portion between the medium contrast portion and the high-density portion, it is necessary that an absolute value of the charging potential ΔV of the maximum density portion which is most resistant to charging is made substantially equal to the development contrast voltage Vcont of the maximum density portion.

The reason why the charging potential ΔV is made substantially equal to the development contrast voltage Vcont is as follows. Attractive force with the photosensitive member also acts to the toner present on the photosensitive member. Therefore, as a result of extensive studies made by the inventors of the present invention, it is found that a condition necessary to suppress the movement of the toner which is caused by the wraparound electric field is that the absolute value of the charging potential ΔV of the maximum density portion is equal to or larger than 95% of the development contrast voltage Vcont of the maximum density portion, that is, Charging potential $$\Delta V|\geqq Vcont\times0.95 \quad \text{(Expression 3)}$$

in other words, $$|Vl-Vs|\geqq Vcont\times0.95.$$

Thus, Expression 2 is substituted into Expression 3 and a resultant expression is rearranged based on the quantity of electric charge per unit weight (Q/M) of the toner on the image bearing member, thereby deriving Expression 1.

When the state of generation of the blank area is compared with the broken line of FIG. 2, it is found that the "blank area" is not generated in the case where an absolute value of Q/M is larger than a value on the broken line. The broken line shown in FIG. 2 corresponds to an equal sign of Expression 1. Therefore, a region above the broken line shown in FIG. 2 corresponds to a region of Expression 1.

Note that values of the respective parameters used to calculate the right-hand side of Expression 1 are as follows. The values other than the vacuum permittivity are measured values.

Vacuum permittivity: ($\epsilon_0$)=$8.854\times10^{-12}$ (F/m)

Relative permittivity of photoconductive layer ($\epsilon_d$): 10

Relative permittivity of toner layer in maximum density portion of toner image on photosensitive member ($\epsilon_t$): 2.5

Thickness of toner layer in maximum density portion of toner image on photosensitive member ($L_t$):

8.04 μm (M/S=0.5 mg/cm$^2$)
8.72 μm (M/S=0.55 mg/cm$^2$)
9.39 μm (M/S=0.6 mg/cm$^2$)
10.07 μm (M/S=0.65 mg/cm$^2$)
10.74 μm (M/S=0.7 mg/cm$^2$)
11.42 μm (M/S=0.75 mg/cm$^2$)
12.09 μm (M/S=0.8 mg/cm$^2$)

When the "thickness of the toner layer" is substituted into Expression 1, it is also necessary to convert the unit (μm) of the thickness of the toner layer into a unit (m). That is, when the "thickness of the toner layer" which is 8.04 μm is substituted into Expression 1, it is necessary to convert the thickness of the toner layer into ($8.04\times10^{-6}$ m).

A method of measuring the respective parameters used in this embodiment will be described.

Thickness $L_d$ of Photoconductive Layer

A flat-shaped photosensitive plate is prepared by forming a layered structure same as the actual photoconductive layer on a metal base. A thickness of the metal base before the layered structure is formed and a thickness of the flat-shaped photosensitive plate after the layered structure is formed are measured by a film thickness meter to calculate a difference between the thicknesses to determine a film thickness $L_d$ of the photoconductive layer.

Relative Permittivity ϵd Photoconductive Layer

A flat-shaped photosensitive plate is prepared by forming a layered structure same as the actual photoconductive layer on a metal base. An electrode smaller than the flat-shaped photosensitive plate is contacted to the flat-shaped photosensitive plate. A direct current voltage is applied to the electrode. At this time, the current passing the electrode is monitored. The monitored current is integrated in time to obtain a charge amount q accumulated in the photoconductive layer. These steps are performed while changing a value of the direct current. The capacitance C of the photosensitive plate is obtained from an amount of change in the charge amount q. Using the measured capacitance C, an electrode area S, and the film thickness $L_d$ of the photoconductive layer obtained by the above method, a permittivity $\epsilon$ of the photoconductive layer is derived from the following equation: $C=\epsilon S/L_d$. A relative permittivity $\epsilon_d$ of the photoconductive layer is derived by dividing the derived permittivity $\epsilon$ of the photoconductive layer by a vacuum permittivity $\epsilon_0$. In this embodiment, the measurement is performed by using the flat-shaped photosensitive plate. If, however, the shape of an electrode is contrived so as to have the same curvature as the photosensitive member, the measurement can be performed by using a drum-shaped photosensitive member.

Thickness of Toner Layer ($L_t$)

A height of a portion in which the toner layer is formed on the photosensitive member and a height of a portion in which the toner layer is not formed on the photosensitive member are measured using a three-dimensional profile measuring laser microscope (produced by Keyence Corporation, VK-9500). A difference between the measured heights is calculated to obtain the thickness $L_t$ of the toner layer.

Relative Permittivity of Toner Layer ($\epsilon_t$)

Figure 16:
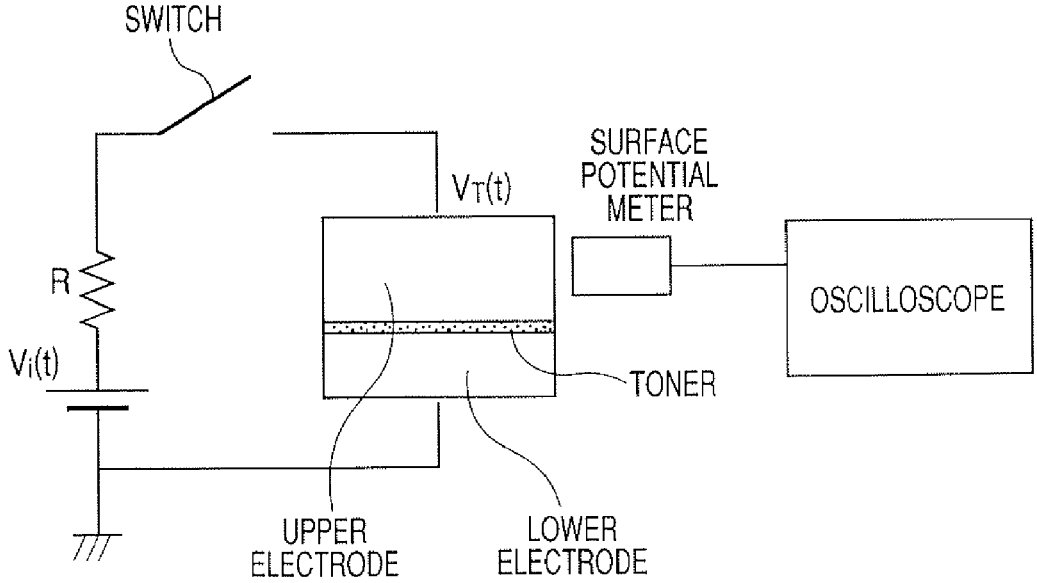
FIG. 16 is a schematic diagram showing an apparatus used to obtain a toner relative permittivity $\epsilon_t$.

In an apparatus shown in FIG. 16, a waveform of a change in potential which is caused when a switch is turned on and off is measured. The relative permittivity $\epsilon_t$ of the toner layer is obtained from the measured waveform. A method of obtaining the relative permittivity of the toner layer will be described in detail later.

In the apparatus shown in FIG. 16, a uniform toner layer having a thickness of approximately 30 mm is sandwiched between two smooth electrodes. A lower electrode of the two electrodes is grounded and an upper electrode thereof is connected with a high-voltage power source through a switch and a resistor R (30 MΩ). A surface potential meter and an oscilloscope are located near the upper electrode such that a potential of the upper electrode can be recorded.

The switch is turned on in the apparatus to apply a potential of several hundreds V to the upper electrode, thereby measuring a rising curve of the potential of the upper electrode.

The permittivity $\epsilon$ of the toner layer is expressed by (Expression a) based on a charge transport equation. Therefore, the permittivity $\epsilon$ of the toner layer is obtained from the rising curve of the potential of the upper electrode. Reference symbol L denotes a toner layer height, S denotes an electrode area, R denotes a resistance between the power source and the switch, $V_i$ denotes a power source voltage, $V_T$ denotes the potential of the upper electrode, and $\tau$ denotes a relaxation time of the toner layer.

$$\varepsilon = \frac{L}{SR} \cdot \frac{V_i - V_T}{\frac{V_T}{\tau} + \frac{dV_T}{dt}} \quad \text{(Expression a)}$$

Note that a differential coefficient related to the voltage $V_T$ is obtained from a falling curve (showing temporal change in potential of the upper electrode which is measured at the time when the switch is changed from an on state to an off state) of the potential of the upper electrode which is measured in advance.

The relaxation time of the toner layer can be calculated by (Expression b). Therefore, the relaxation time $\tau$ of the toner layer at the voltage $V_T$ is obtained using a differential coefficient obtained from the falling curve of the potential of the upper electrode.

$$\tau = -\frac{V}{(dV/dt)} \quad \text{(Expression b)}$$

The permittivity $\epsilon$ of the toner layer which is obtained as described above is divided by the vacuum permittivity $\epsilon_0$ to obtain the relative permittivity $\epsilon_t$ of the toner layer.

(2-2) Part 2

A state of generation of the "blank area" in the case where the development contrast voltage Vcont on the maximum density portion is set based on the following conditions is examined. That is, in the case where the weight per unit area (M/S) of toner of the maximum density portion on the photosensitive member is 0.5 mg/cm$^2$ to 0.8 mg/cm$^2$, the quantity of electric charge per unit weight (Q/M) of toner on the photosensitive member is changed to examine the state of generation of the "blank area" at the time when an image in which the medium contrast portion and the maximum density portion are adjacent to each other is outputted.

Note that the conditions other than the development contrast voltage Vcont on the maximum density portion are identical to those in the case of (2-1).

Development contrast voltage on maximum density portion (Vcont): 150 V and 250 V The maximum development contrast voltage Vcont on the maximum density portion is set to 150 V to 250 V. This is because the set voltage is suitable to maintain a γ-value necessary to obtain tone reproduction for printing.

Figure 11:
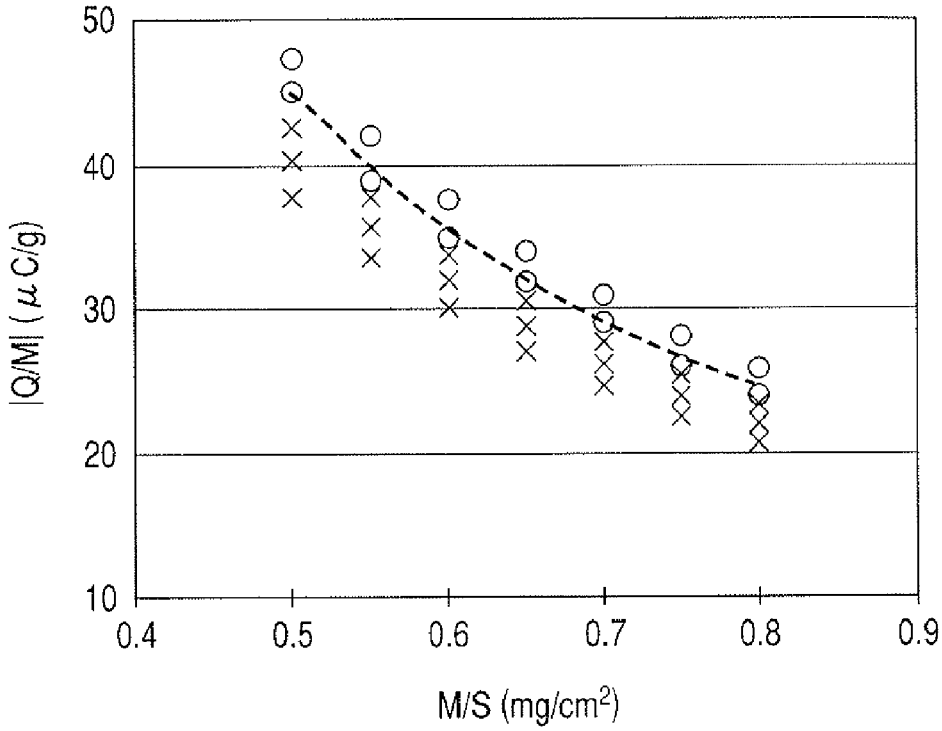
FIG. 11 is a graph showing a result obtained by study in Embodiment 1 (2-2) of the present invention.
Figure 12:
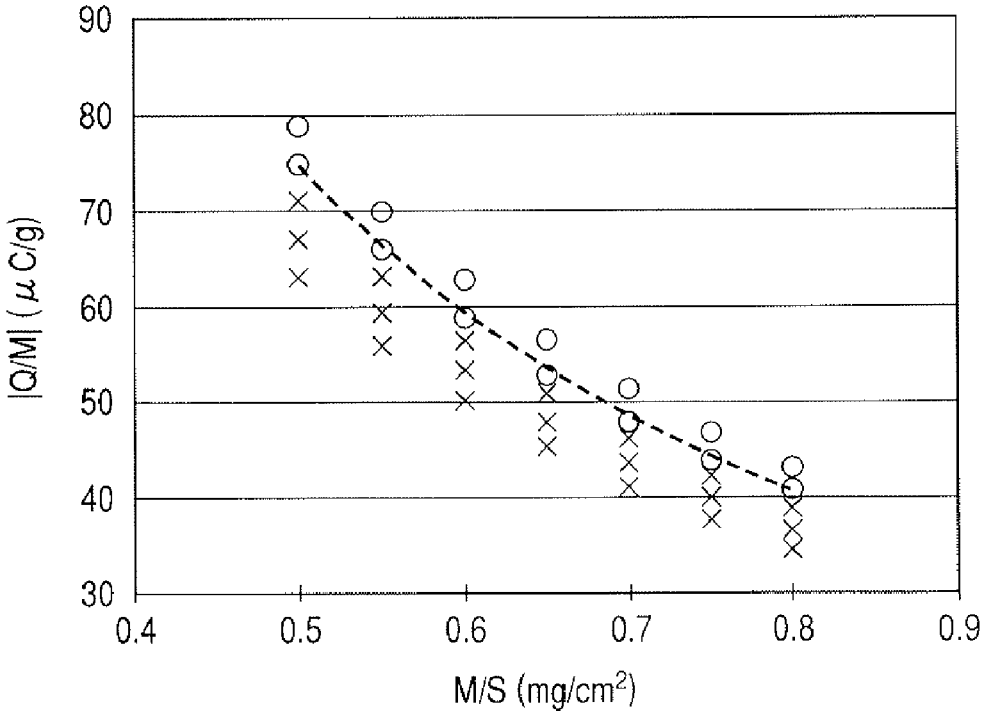
FIG. 12 is a graph showing a result obtained by study in Embodiment 1 (2-2) of the present invention.

FIG. 11 shows a result obtained by study in the case of Vcont=150 V. FIG. 12 shows a result obtained by study in the case of Vcont=250 V. In each of FIGS. 11 and 12, a mark "o" indicates that the "blank area" is not generated and a mark "x" indicates that the "blank area" is generated. For the image forming apparatus according to this embodiment, the reverse developing system is employed and the negatively-charged toner is used. Therefore, the ordinate in each of FIGS. 11 and 12 indicates an absolute value of the quantity of electric charge per unit weight (Q/M) of the toner on the photosensitive member.

As is apparent from FIG. 11, when Vcont is 150 V, in each of:

the case of M/S=0.5 mg/cm$^2$ . . . |Q/M|≧45 μC/g;
the case of M/S=0.55 mg/cm$^2$ . . . |Q/M|≧39 μC/g;
the case of M/S=0.6 mg/cm$^2$ . . . |Q/M|≧35 μC/g;
the case of M/S=0.65 mg/cm$^2$ . . . |Q/M|≧32 μC/g;
the case of M/S=0.7 mg/cm$^2$ . . . |Q/M|≧29 μC/g;
the case of M/S=0.75 mg/cm$^2$ . . . |Q/M|≧26 μC/g; and
the case of M/S=0.8 mg/cm$^2$ . . . |Q/M|≧24 μC/g,
the "blank area" is not generated.

A broken line shown in FIG. 11 indicates the right-hand side values of Expression 1 in respective conditions in the case of Vcont=150 V. Table 2 shows values in the typical cases of M/S. Although the units shown in Table 2 are not equal to the units described in Expression 1,the dimension of the left-hand side of Expression 1 is equal to that of the right-hand side thereof. Therefore, it is necessary to convert the units shown in Table 2 into the unit described in Expression 1. For example, when (M/S=0.5 mg/cm$^2$) shown in Table 2 is to be substituted into Expression 1,it is necessary to convert (M/S=0.5 mg/cm$^2$) into (M/S=5 mg/m$^2$). At this time, it is necessary to convert (Q/M=45.0 μC/g) of the right-hand side of Expression 1 which is shown in Table 2 into (45.0×10$^{-6}$ C/g).

TABLE 2

| | 0.5 mg/cm$^2$ | 0.55 mg/cm$^2$ | 0.6 mg/cm$^2$ | 0.65 mg/cm$^2$ | 0.7 mg/cm$^2$ | 0.75 mg/cm$^2$ | 0.8 mg/cm$^2$ |
|---|---|---|---|---|---|---|---|
| (Expression 1) Right-hand side | 45.0 μC/g | 39.9 μC/g | 35.8 μC/g | 32.3 μC/g | 29.3 μC/g | 26.8 μC/g | 24.6 μC/g |

When the state of generation of the blank area is compared with the broken line in FIG. 11, it is found that the "blank area" is not generated in the case where an absolute value of Q/M is larger than a value on the broken line.

Next, the case of Vcont=250 V will be described.

As is apparent from FIG. 12, when Vcont is 250 V, in each of:

the case of M/S=0.5 mg/cm$^2$ . . . |Q/M|≧75 μC/g;
the case of M/S=0.55 mg/cm$^2$ . . . |Q/M|≧66 μC/g;
the case of M/S=0.6 mg/cm$^2$ . . . |Q/M|≧59 μC/g;
the case of M/S=0.65 mg/cm$^2$ . . . |Q/M|≧53 μC/g;
the case of M/S=0.7 mg/cm$^2$ . . . |Q/M|≧48 μC/g;
the case of M/S=0.75 mg/cm$^2$ . . . |Q/M|≧44 μC/g; and
the case of M/S=0.8 mg/cm$^2$ . . . |Q/M|≧41 μC/g,
the "blank area" is not generated.

A broken line shown in FIG. 12 indicates the right-hand side values of Expression 1 in respective conditions in the case of Vcont=250 V. Table 3 shows values in the typical cases of M/S. When the values of the units shown in Table 3 are actually to be substituted into Expression 1,it is necessary to convert the units shown in Table 3 into the unit described in Expression 1.

TABLE 3

| | 0.5 mg/cm$^2$ | 0.55 mg/cm$^2$ | 0.6 mg/cm$^2$ | 0.65 mg/cm$^2$ | 0.7 mg/cm$^2$ | 0.75 mg/cm$^2$ | 0.8 mg/cm$^2$ |
|---|---|---|---|---|---|---|---|
| (Expression 1) Right-hand side | 75.0 μC/g | 66.6 μC/g | 59.6 μC/g | 53.8 μC/g | 48.9 μC/g | 44.6 μC/g | 41.0 μC/g |

When the state of generation of the blank area is compared with the broken line in FIG. 12, it is found that the "blank area" is not generated in the case where an absolute value of Q/M is larger than a value on the broken line.

Note that the values of the respective parameters used to calculate the right-hand side of Expression 1 are equal to those in the case of (2-1), other than Vcont.

(2-3) Part 3

A state of generation of the "blank area" in the case where the thickness of the photoconductive layer is set based on the following conditions at Vcont=150 V is examined. That is, in the case where the weight per unit area (M/S) of toner of the maximum density portion on the photosensitive member is 0.5 mg/cm$^2$ to 0.8 mg/cm$^2$, the quantity of electric charge per unit weight (Q/M) of toner on the photosensitive member is changed to examine the state of generation of the "blank area" at the time when an image in which the medium contrast portion and the maximum density portion are adjacent to each other is outputted. The conditions other than the thickness of the photoconductive layer and Vcont are identical to those in the case of (2-1).

Thickness of Photoconductive layer ($L_d$): 15 μm, 20 μm, 30 μm, and 52 μm

Figure 13:
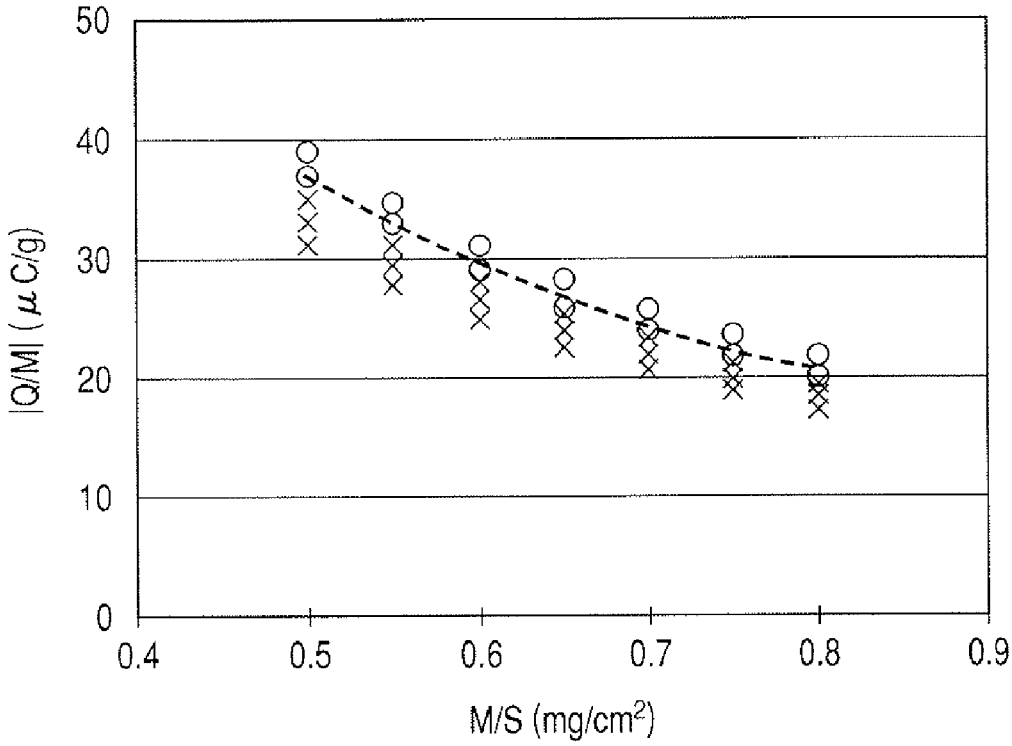
FIG. 13 is a graph showing a result obtained by study in Embodiment 1 (2-3) of the present invention.
Figure 14:
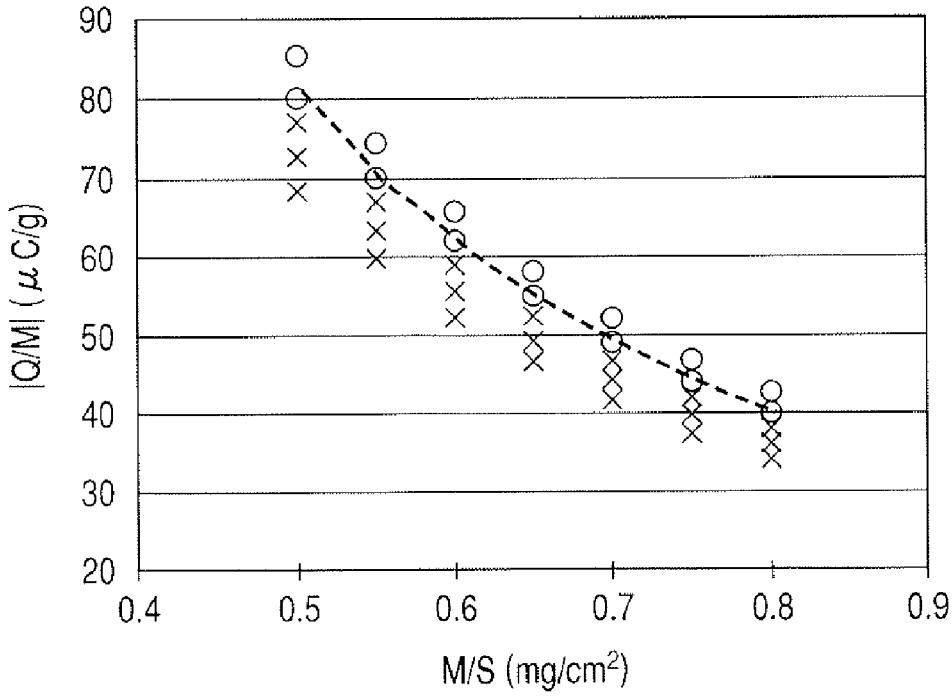
FIG. 14 is a graph showing a result obtained by study in Embodiment 1 (2-3) of the present invention.

FIG. 13 shows a typical example of a result obtained by study in the case where the thickness of the photoconductive layer is 52 μm. FIG. 14 shows a typical example of a result obtained by study in the case where the thickness of the photoconductive layer is 15 μm. In each of FIGS. 13 and 14, a mark "o" indicates that the "blank area" is not generated and a mark "x" indicates that the "blank area" is generated. The ordinate in each of FIGS. 13 and 14 indicates an absolute value of the quantity of electric charge per unit weight (Q/M) of the toner on the photosensitive member. When "the thickness of the photoconductive layer" is to be substituted into Expression 1, of course, the unit is converted from (μm) into (m). The broken line shown in each of FIGS. 13 and 14 corresponds to a case where an equal sign of Expression 1 is established.

As is apparent from FIG. 13, when thickness of the photoconductive layer is 52 μm, in each of:

the case of M/S=0.5 mg/cm$^2$ . . . |Q/M|≧37 μC/g;
the case of M/S=0.55 mg/cm$^2$ . . . |Q/M|≧33 μC/g;
the case of M/S=0.56 mg/cm$^2$ . . . |Q/M|≧29 μC/g;
the case of M/S=0.65 mg/cm$^2$ . . . |Q/M|≧26 μC/g;
the case of M/S=0.67 mg/cm$^2$ . . . |Q/M|≧24 μC/g;
the case of M/S=0.75 mg/cm$^2$ . . . |Q/M|≧22 μC/g; and
the case of M/S=0.8 mg/cm$^2$ . . . |Q/M|≧20 μC/g,
the "blank area" is not generated.

A broken line shown in FIG. 13 indicates the right-hand side values of Expression 1 in respective conditions in the case of thickness of the photoconductive layer is 52 μm. Table 4 shows values in the typical cases of M/s.

TABLE 4

| | 0.5 mg/cm$^2$ | 0.55 mg/cm$^2$ | 0.6 mg/cm$^2$ | 0.65 mg/cm$^2$ | 0.7 mg/cm$^2$ | 0.75 mg/cm$^2$ | 0.8 mg/cm$^2$ |
|---|---|---|---|---|---|---|---|
| (Expression 1) Right-hand side | 37.1 μC/g | 33.0 μC/g | 29.7 μC/g | 26.9 μC/g | 24.5 μC/g | 22.5 μC/g | 20.7 μC/g |

When the state of generation of the blank area is compared with the broken line in FIG. 13, it is found that the "blank area" is not generated in the case where an absolute value of Q/M is larger than a value on the broken line.

Next, the case of the thickness of the photoconductive layer=15 μm will be described.

As is apparent from FIG. 14, when thickness of the photoconductive layer is 15 μm, in each of:

the case of M/S=0.5 mg/cm$^2$ . . . |Q/M|≧80 μC/g;
the case of M/S=0.55 mg/cm$^2$ . . . |Q/M|≧70 μC/g;
the case of M/S=0.6 mg/cm$^2$ . . . |Q/M|≧62 μC/g;
the case of M/S=0.65 mg/cm$^2$ . . . |Q/M|≧55 μC/g;
the case of M/S=0.7 mg/cm$^2$ . . . |Q/M|≧49 μC/g;
the case of M/S=0.75 mg/cm$^2$ . . . |Q/M|≧44 μC/g; and
the case of M/S=0.8 mg/cm$^2$ . . . |Q/M|≧40 μC/g,
the "blank area" is not generated.

A broken line shown in FIG. 14 indicates the right-hand side values of Expression 1 in respective conditions in the case of the photoconductive layer=15 μm. Table 5 shows values in the typical cases of M/S.

TABLE 5

| | 0.5 mg/cm$^2$ | 0.55 mg/cm$^2$ | 0.6 mg/cm$^2$ | 0.65 mg/cm$^2$ | 0.7 mg/cm$^2$ | 0.75 mg/cm$^2$ | 0.8 mg/cm$^2$ |
|---|---|---|---|---|---|---|---|
| (Expression 1) Right-hand side | 81.2 μC/g | 70.7 μC/g | 62.3 μC/g | 55.2 μC/g | 49.4 μC/g | 44.5 μC/g | 40.3 μC/g |

When the state of generation of the blank area is compared with the broken line of FIG. 14, it is found that the "blank area" is not generated in the case where an absolute value of Q/M is larger than a value on the broken line.

Note that the values of the respective parameters used to calculate the right-hand side of Expression 1 are equal to those in the case of (2-1), other than the thickness of the photoconductive layer and Vcont.

Even in the cases where the thickness of the photoconductive layer is 20 μm and 30 μm, when the absolute value of Q/M is equal to or larger than the right-hand side value of Expression 1,it is found that the "blank area" is not generated.

Therefore, in the case the absolute value of the quantity of electric charge per unit weight (Q/M) of the toner on the photosensitive member is set to a value equal to or larger than the right-hand side value of Expression 1, even when an amorphous silicon photosensitive member having a large capacitance is used, charging failure is reduced to prevent the generation of the "blank area". Thus, a high-resolution image can be obtained.

Embodiment 2

In this embodiment, an example, in which a toner particle diameter is reduced in the structure described in Embodiment 1,will be described.

A background that the toner particle diameter is reduced is as follows. In order to output, as an electrophotography, a high-resolution image which surpasses other outputted images in a printing market, a method of reducing a laser spot diameter to obtain high resolution is employed. However, in order to more accurately visualize a high-resolution electrostatic latent image by a developing process, it is necessary that the toner particle diameter be small.

Therefore, in this embodiment, an example of an image forming apparatus whose resolution is 2400 dpi will be described.

In this embodiment, the exposure device 3 including a blue laser whose light emission wavelength is approximately 420 nm is used to obtain the resolution of 2400 dpi.

A spot diameter of 2400 dpi is approximately 10.6 μm. In order to more accurately visualize (i.e., reproduce) an electrostatic latent image formed of dots by the developing process, toner whose particle diameter is 3.5 μm which is approximately ⅓ of the spot diameter is used.

Figure 3:
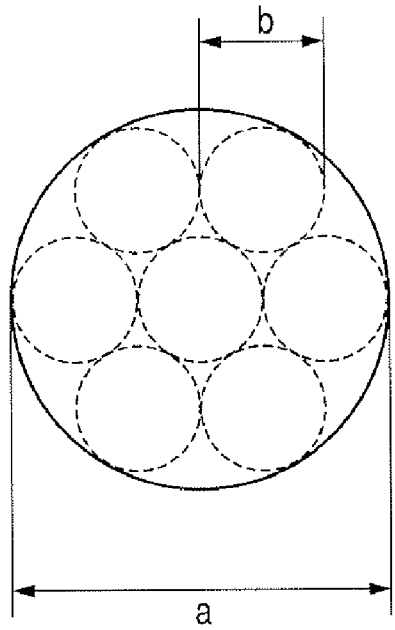
FIG. 3 is an explanatory view showing a toner particle diameter relative to a laser spot diameter in Embodiment 2 of the present invention.

The reason why the toner particle diameter is set to ⅓ of the spot diameter is that, in order to reproduce the dot latent image, it is preferable to arrange toner particles in a hexagonal shape relative to a laser spot having a diameter "a" as shown in FIG. 3 and a toner particle diameter "b" necessary for such an arrangement is a size of approximately (a/3).

The image formation operation of the image forming apparatus is identical to that in Embodiment 1 and thus the detailed description is omitted here.

As in the case of Embodiment 1,a state of generation of the "blank area" is examined. That is, in the case where the weight per unit area (M/S) of toner of the maximum density portion on the photosensitive member is 0.5 mg/cm$^2$ to 0.8 mg/cm$^2$, the quantity of electric charge per unit weight (Q/M) of toner on the photosensitive member is changed to examine the state of generation of the "blank area" at the time when an image, in which the medium contrast portion and the maximum density portion are adjacent to each other, is outputted.

The development contrast voltage Vcont on the maximum density portion is 200 V and the development contrast voltage Vcont-h on the medium contrast portion is 100 V.

The Q/M and M/S are each controlled by adjusting a type of an extraneous additive added to toner, an extraneous additive amount, and a toner/carrier ratio.

Figure 4:
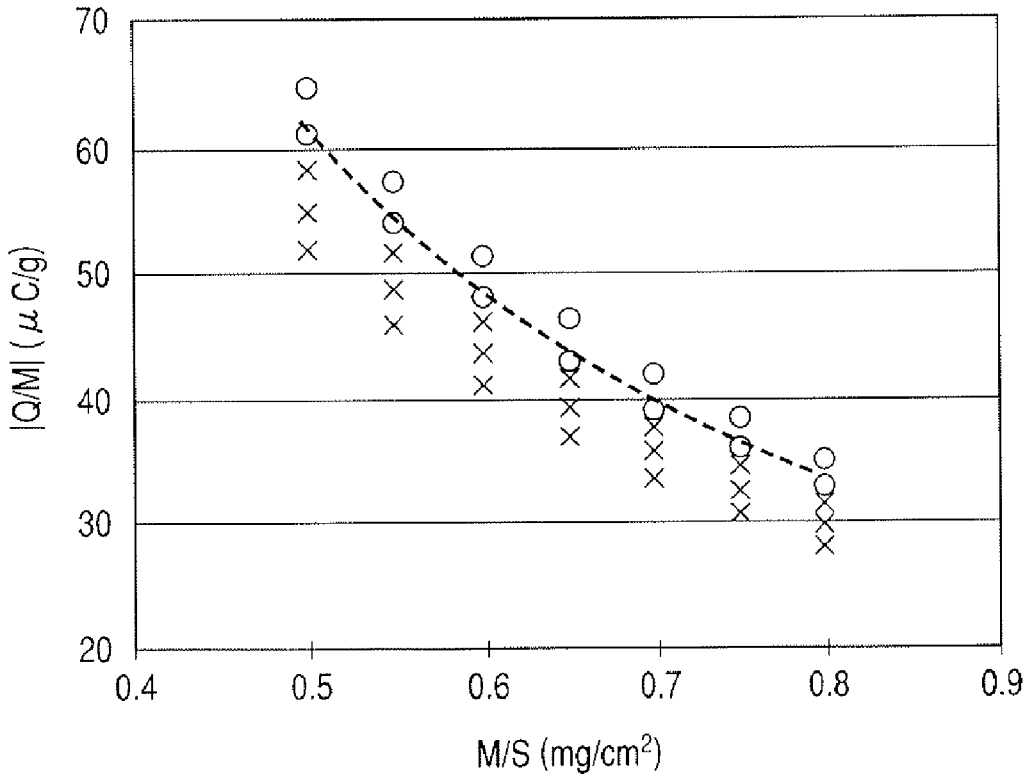
FIG. 4 is a graph showing a result obtained by study in Embodiment 2 of the present invention.
Figure 5:
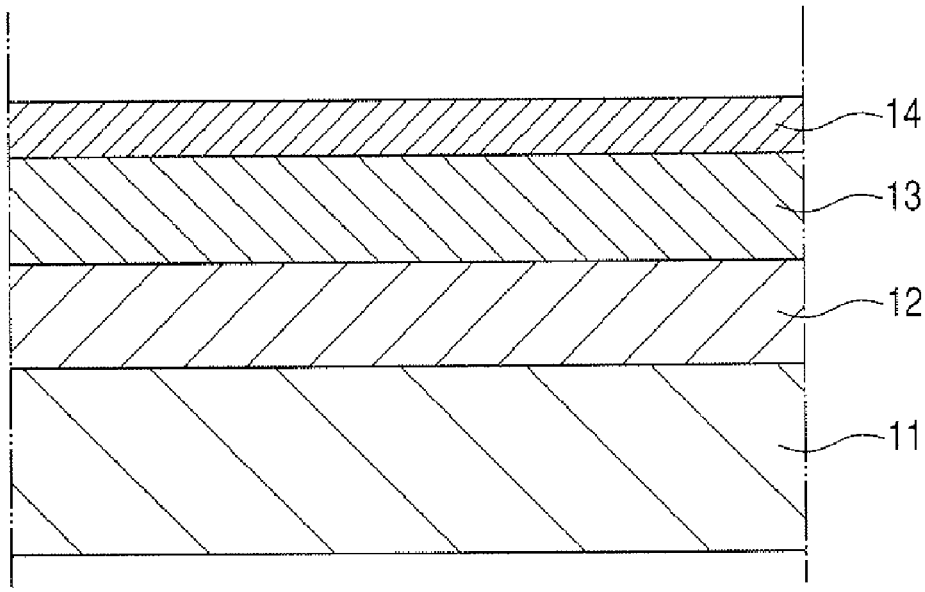
FIG. 5 is a layer structural model view showing an organic photoreceptor.

FIG. 4 shows a result obtained by study. In FIG. 4, a mark "o" indicates that the "blank area" is not generated and a mark "x" indicates that the "blank area" is generated. The negatively-charged toner is used for the image forming apparatus according to this embodiment. Therefore, the ordinate indicates an absolute value of the quantity of electric charge per unit weight (Q/M) of the toner on the photosensitive member. As is apparent from FIG. 4, in each of:

the case of M/S=0.5 mg/cm$^2$ . . . |Q/M|≧61 μC/g;
the case of M/S=0.55 mg/cm$^2$ . . . |Q/M|≧54 μC/g;
the case of M/S=0.6 mg/cm$^2$ . . . |Q/M|≧48 μC/g;
the case of M/S=0.65 mg/cm$^2$ . . . |Q/M|≧43 μC/g;
the case of M/S=0.7 mg/cm$^2$ . . . |Q/M|≧39 μC/g;
the case of M/S=0.75 mg/cm$^2$ . . . |Q/M|≧36 μC/g; and
the case of M/S=0.8 mg/cm$^2$ . . . |Q/M|≧33 μC/g,
the "blank area" is not generated.

A broken line shown in FIG. 4 indicates right-hand side values of Expression 1 in respective conditions. Table 6 shows values in the typical cases of M/S.

TABLE 6

| | 0.5 mg/cm$^2$ | 0.55 mg/cm$^2$ | 0.6 mg/cm$^2$ | 0.65 mg/cm$^2$ | 0.7 mg/cm$^2$ | 0.75 mg/cm$^2$ | 0.8 mg/cm$^2$ |
|---|---|---|---|---|---|---|---|
| (Expression 1) Right-hand side | 61.4 μC/g | 54.5 μC/g | 48.8 μC/g | 44.0 μC/g | 39.9 μC/g | 36.4 μC/g | 33.4 μC/g |

When the state of generation of the blank area is compared with the broken line in FIG. 4, it is found that the "blank area" is not generated in the case where an absolute value of Q/M is larger than a value on the broken line.

Note that values of the respective parameters used to calculate the right-hand side of Expression 1 are as follows. The values other than the vacuum permittivity are measured values.

Vacuum permittivity ($\epsilon_0$): $8.854\times10^{-12}$ (F/m)

Relative permittivity of photoconductive layer ($\epsilon_d$): 10

Relative permittivity of toner layer ($\epsilon_t$): 2.5

Thickness of toner layer on photoreceptor ($L_t$):

7.4 μm (M/S=0.5 mg/cm$^2$)

8.07 μm (M/S=0.55 mg/cm$^2$)

8.75 μm (M/S=0.6 mg/cm$^2$)

9.42 μm (M/S=0.65 mg/cm$^2$)

10.10 μm (M/S=0.7 mg/cm$^2$)

10.77 μm (M/S=0.75 mg/cm$^2$)

11.45 μm (M/S=0.8 mg/cm$^2$)

As a result of study in conditions in which the development contrast voltage Vcont on the maximum density portion is 150 V and 250 V, it is found that the "blank area" is not generated in the case where the absolute value of Q/M is equal to or larger than the right-hand side value of Expression 1.

As a result of study in conditions in which the thickness $L_d$ of the photoconductive layer is 15 μm, 20 μm, 30 μm, and 52 μm, it is found that the "blank area" is not generated in the case where the absolute value of Q/M is equal to or larger than the right-hand side value of Expression 1.

As a result of study in the following toner particle diameter conditions in order to deal with various resolutions, it is found that the "blank area" is not generated in the case where the absolute value of Q/M is equal to or larger than the right-hand side value of Expression 1.

Toner particle diameter: 5 μm, 3 μm, and 1.8 μm

The toner particle diameter in the present invention is a weight-average particle diameter obtained by the following measurement method. First, 100 ml to 150 ml of electrolytic aqueous solution (for example, aqueous solution containing approximately 1% of NaCl), to which several ml of surface active agent (preferably alkylbenzene sulfonate) is added, is prepared. Then, 2 mg to 20 mg of toner is added to the electrolytic aqueous solution. A resultant solution is subjected to dispersion processing for several minutes by an ultrasonic distributor. The solution is subjected to measurement using a Coulter counter (TA-II, produced by Coulter K. K.) to obtain the weight-average particle diameter.

Even when the toner particle diameter is reduced in addition to using the amorphous silicon photosensitive member whose capacitance is large, the absolute value of the quantity of electric charge per unit weight (Q/M) of the toner on the image bearing member is set to a value equal to or larger than the right-hand side value of Expression 1. Therefore, the charging failure is reduced to prevent the generation of the "blank area", so that a high-resolution image can be obtained.

In each of Embodiments 1 and 2, the amorphous silicon photosensitive member is used as the image bearing member. However, the present invention is effective for an image forming apparatus using not only the amorphous silicon photosensitive member but also a large-capacitance image bearing member whose capacitance per unit area is equal to or larger than $1.7\times10^{-6}$ (F/m$^2$). That is, the absolute value of the quantity of electric charge per unit weight (Q/M) of the toner on the above-mentioned image bearing member is set to a value equal to or larger than the right-hand side value of Expression 1. Therefore, the charging failure is reduced to prevent the generation of the "blank area", so that a high-resolution image can be obtained.

As described above, even in the case of a high-capacitance organic photoreceptor, whose capacitance is made equal to or larger than $1.7\times10^{-6}$ (F/m$^2$) by thin film processing, the charging failure is reduced to prevent the generation of the "blank area", so that a high-resolution image can be obtained.

In each of Embodiments 1 and 2,a color toner in which the relative permittivity $\epsilon_t$ of the toner layer is equal to 2.5 is used. However, the present invention is not limited to this value. Even in the case of a black toner containing carbon in which the relative permittivity of the toner layer is relatively high, the absolute value of the quantity of electric charge per unit weight (Q/M) of the toner on the image bearing member is set to a value equal to or larger than the right-hand side value of Expression 1. Therefore, the charging failure is reduced to prevent the generation of the "blank area", so that a high-resolution image can be obtained.

Note that, as described above, when the units of Q/M, M/S, $L_t$, and $L_d$ described in the embodiments and the drawings are different from the units described in Expression 1,it is necessary that the units of Q/M, M/S, $L_t$, and $L_d$ be converted into the units described in Expression 1 and then be substituted into Expression 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2005-274079,filed Sep. 21, 2005 and 2006-249255,filed Sep. 14, 2006 which are hereby incorporated by reference herein in these entirety.

What is claimed is:

1. An image forming apparatus, comprising:

an image bearing member including a photoconductive layer having a capacitance per unit area which is equal to or larger than $1.7\times10^{-6}$ (F/m$^2$); and a developing device, which develops an electrostatic latent image formed on said image bearing member using a developer containing toner and a carrier to form a toner image on said image bearing member, said developing device including a developer carrying member, which carries the developer, a development bias voltage being applied to said developer carrying member, wherein the following Expression 1 is satisfied:

$$\left|\frac{Q}{M}\right| \geq \frac{0.95\times Vcont}{\left(\frac{M}{S}\right)\times\left(\frac{L_t}{2\varepsilon_0\varepsilon_t}+\frac{Ld}{\varepsilon_0\varepsilon_d}\right)} \quad \text{(Expression 1)}$$

where

Q/M (C/g) indicates a quantity of electric charge per unit weight of the toner image formed on said image bearing member, Vcont (V) indicates a potential difference between a direct current component of the development bias voltage and a surface potential of said image bearing member with respect to a maximum density portion of the toner image formed on said image bearing member, M/S ($g/m^2$) indicates a toner weight per unit area of the maximum density portion of the toner image formed on said image bearing member, $L_t$ (m) indicates a thickness of a toner layer in the maximum density portion of the toner image formed on said image bearing member, $L_d$ (m) indicates a thickness of the photoconductive layer, $\epsilon_t$ indicates a relative permittivity of the toner layer, $\epsilon_d$ indicates a relative permittivity of the photoconductive layer, and $\epsilon_0$ (F/m) indicates a vacuum permittivity.

2. An image forming apparatus according to claim 1, wherein said image bearing member comprises an amorphous silicon.

3. An image forming apparatus according to claim 1, wherein the toner weight per unit area of the maximum density portion of the toner image formed on said image bearing member is equal to or larger than 0.5 $mg/cm^2$ and equal to or smaller than 0.8 $mg/cm^2$.

4. An image forming apparatus according to claim 1, wherein Vcont satisfies a relationship of $150\ V \leqq Vcont \leqq 250\ V$.

5. An image forming apparatus according to claim 3, wherein Vcont satisfies a relationship of $150\ V \leqq Vcont \leqq 250\ V$.

6. An image forming apparatus according to claim 1, wherein the toner has a weight-average particle diameter equal to or smaller than 7 μm.

7. An image forming apparatus, comprising:

an image bearing member including a photoconductive layer having a capacitance per unit area which is equal to or larger than $1.7\times10^{-6}$ ($F/m^2$); and a developing device, which develops an electrostatic latent image formed on said image bearing member using a developer containing toner and a carrier to form a toner image on said image bearing member, said developing device including a developer carrying member for carrying the developer, a development bias voltage being applied to said developer carrying member, wherein the following relationship is satisfied:

$$|Vl-Vs| \leqq Vcont \times 0.95,$$

where

Vcont (V) indicates a potential difference between a direct current component of the development bias voltage and a surface potential of said image bearing member with respect to a maximum density portion of the toner image formed on said image bearing member, Vl (V) indicates a surface potential of said image bearing member before development with respect to the maximum density portion of the toner image formed on said image bearing member, and Vs (V) indicates a surface potential of the toner image after development on the maximum density portion of the toner image formed on said image bearing member.

* * * * *